US005195331A

United States Patent [19]

Zimmern et al.

[11] Patent Number: 5,195,331

[45] Date of Patent: Mar. 23, 1993

[54] METHOD OF USING A THERMAL EXPANSION VALVE DEVICE, EVAPORATOR AND FLOW CONTROL MEANS ASSEMBLY AND REFRIGERATING MACHINE

[75] Inventors: Bernard Zimmern, 6 New St., East Norwalk, Conn. 06855; Jean L Picouet, Bridgeport, Conn.

[73] Assignee: Bernard Zimmern, East Norwalk, Conn.

[21] Appl. No.: 690,335

[22] Filed: Apr. 26, 1991

Related U.S. Application Data

[63] Continuation of Ser. No. 448,271, Dec. 11, 1989, abandoned.

[30] Foreign Application Priority Data

Dec. 9, 1988 [FR] France ..... 88 16207

[51] Int. Cl.[5] ..... G05D 23/30

[52] U.S. Cl. ..... 62/202; 62/225

[58] Field of Search ..... 62/202, 225, 224; 236/92 B, 99 D, 99 J, DIG. 6

[56] References Cited

U.S. PATENT DOCUMENTS

| | | | |
|---|---|---|---|
| 1,408,744 | 3/1922 | Keen et al. | 62/224 X |
| 1,902,784 | 3/1933 | Larkin | 62/224 X |
| 1,969,102 | 8/1934 | Shenton et al. . | |
| 2,078,966 | 5/1937 | Newill | 62/202 X |
| 2,279,787 | 4/1942 | Huggins | 62/202 X |
| 2,534,455 | 12/1950 | Koontz | 62/202 |
| 2,624,181 | 1/1953 | Erwin et al. . | |
| 2,857,106 | 10/1958 | Porland . | |
| 4,467,613 | 8/1984 | Behr et al. | 62/115 |

FOREIGN PATENT DOCUMENTS

| | | | |
|---|---|---|---|
| 1178599 | 5/1959 | France | 62/202 |
| 2514114 | 4/1983 | France . | |
| 0073345 | 6/1979 | Japan | 62/202 |
| 939659 | 10/1963 | United Kingdom . | |
| 1427926 | 3/1976 | United Kingdom . | |
| 8204142 | 11/1982 | World Int. Prop. O. . | |

OTHER PUBLICATIONS

Refrigeration & Air Conditioning, Jordon et al. May 1948, p. 45.

Engineering Thermodynamics, H. J. Stoever Sep. 1956 p. 28.

*Primary Examiner*—William Wayner

*Attorney, Agent, or Firm*—Finnegan, Henderson, Farabow, Garrett & Dunner

[57] ABSTRACT

The expansion valve 103 of the refrigerating machine is controlled by the difference between the pressure in a bulb 104 containing a fixed amount of fluid and the pressure in the evaporator 2. The bulb is mounted in the discharge pipe 1 of the evaporator and is heated by a resistor. In the absence of droplets of liquid refrigerant in the flow through the discharge pipe, i.e when the refrigerant flow rate tends to become too low with respect to the cold demand, the resistor heats up the fluid in the bulb, the pressure in the bulb increases and moves the expansion valve to a more opened position. As soon as droplets hit the bulb in the discharge pipe, said droplets cool down the bulb despite the heating effect of the resistor and the expansion valve is moved to a more closed position. Thus, the flow rate control uses variations in heat transfer coefficients in the discharge pipe rather than superheat temperature in the discharge pipe. The evaporator may be small-sized because it does not have to produce superheat.

5 Claims, 1 Drawing Sheet

METHOD OF USING A THERMAL EXPANSION VALVE DEVICE, EVAPORATOR AND FLOW CONTROL MEANS ASSEMBLY AND REFRIGERATING MACHINE

This application is a continuation of application Ser. No. 448,271, filed Dec. 11, 1989 now abandoned.

This invention relates to a method of using a thermal expansion valve device comprising a bulb at least partially filled with a liquid.

This invention also relates to an evaporator and flow control means assembly.

This invention further relates to a refrigerating machine.

As is well known, refrigerating machines, such as those used for example for refrigeration or air-conditioning, comprise a compressor which compresses a refrigerant fluid in the gaseous state. The fluid is then cooled and condensed by contact with a so-called "hot source" (less hot than the gas coming from the compressor) and the pressure of the condensed fluid is then decreased through an expansion valve down to a pressure low enough for vaporization of the fluid b contact with a so-called "cold source", whereafter the vaporized gas is returned to the compressor. During its vaporization, the fluid absorbs heat from the cold source, thus creating the desired refrigerating effect.

This type of machine needs to be controlled so as to avoid two drawbacks. Firstly, if the amount of heat available at the cold source is low, high quantities of unevaporated liquid ma be returned to the compressor. This would damage the compressor and, in any event, results in a waste of energy in the machine (the machine has produced more cold than necessary). Secondly, if the amount of heat available at the cold source is high, the liquid flow rate arriving at the evaporator may not be high enough for maintaining the cold source temperature at the desired low level.

To obtain the required regulation or control, it is known to control the expansion valve and the evaporator by using a thermal expansion valve, i.e. an expansion valve connected to a bulb partially filled with liquid, generally the same liquid as the fluid used in the refrigerating circuit. A membrane has one side thereof exposed to the pressure in the bulb and an other side thereof exposed to the pressure in the evaporator. The membrane acts on a valve flow control means of the expansion valve, against a biasing spring. The bulb is normally attached to the outside of the discharge pipe through which the refrigerant fluid leaves the evaporator towards the compressor, and the flow control means opens only when the superheat of the gas is heating the liquid in the bulb to a point where its pressure exceeds the pressure in the evaporator by the amount of the pressure provided b the spring.

A drawback of this type of control is that it needs superheat to operate. As a matter of fact, according to the laws of thermodynamics, in the absence of superheat, i.e. when there is a mixture of liquid and gas in the discharge pipe, the temperature in the discharge pipe is only a function of the pressure, and not a function of the percentage of liquid in the mixture. Since the pressure in the bulb is only a function of the temperature, the pressure in the bulb would be the same irrespective of the proportion of liquid in the discharge pipe of the evaporator and no regulation could be possible.

The providing of such superheat, as is necessary for the regulation, means that the evaporator has to be substantially enlarged and this significantly increases the cost. In the superheat region of evaporation, the coefficient of thermal exchange is much lower than in the area where the evaporator contains some liquid.

In air-conditioning systems called water-chillers —where an intermediary medium, i.e. water, is cooled and in turn cools the air—the size of the evaporator could be roughly divided b half if the superheat, normally 5° C., could be eliminated.

This is not surprising as the average temperature difference between the water and the refrigerant itself is no more than 5° to 7° C. and the heat-exchanges with a gas under a so low temperature difference have a very low efficiency.

Since the cost of such evaporators is 20 to 30% of the whole air-conditioning system, the possible cost savings are very substantial.

Attempts having made to reduce the superheat by electronic expansion valves which basically measure the temperatures of the gas and of the liquid at the evaporator to electronically control the valve. However, such electronic expansion valves are very expensive and they nevertheless need superheat to operate, usually 2°-3° C., whereby no substantial saving has been possible.

Attempts have also been made to displace the operating point of a thermal expansion valve using a bulb by heating the bulb with separate heating means such as an electrical resistor ; such a method is for instance found in U.S. Pat. No. 4 467 613. However, such a method needs a difficult matching of the resistor ohmic value, and this matching may not be appropriate for various operating conditions.

The first object of this invention is a method of using a thermal expansion valve device comprising a bulb at least partially filled with a liquid, connected to one side of a differential pressure measuring device, an other side of said differential pressure measuring device being exposed to the pressure in the evaporator, said differential pressure measuring device acting against biasing means to control the position of flow controlling means, said bulb being connected to a discharge pipe of said evaporator and carrying heating means, and characterized by positioning said bulb at least partially in said discharge tube.

A second object of this invention is an evaporator and flow control means assembly comprising:

an evaporator having a refrigerant inlet connected to a thermal expansion valve and a refrigerant discharge pipe provided with a bulb at least partially filled with a liquid;

a differential pressure measuring means having a first input connected to said bulb and a second input exposed to the pressure in said evaporator;

means for positioning a flow control element of the thermal expansion valve as a function of a differential pressure as measured b the differential pressure measuring means;

heating means connected to the bulb, characterized b the bulb being at least partially mounted in the discharge pipe of the evaporator so as to be at least partially exposed to refrigerant flow in the discharge pipe.

A third object of the invention is a refrigerating machine comprising an evaporator and flow control means assembly according to the second object.

As soon as the gas leaving the evaporator becomes wet, i.e. contains droplets, these droplets hit the bulb and cool very quickly the liquid inside the bulb, thereby decreasing the pressure in the bulb and thus closing the flow control means. On the contrary, as soon as the gas leaving the evaporator becomes dry, the cooling effect of the refrigerant gas onto the liquid in the bulb becomes much less efficient and the electrical resistor starts heating the liquid in the bulb to a temperature which is over the temperature of the refrigerant gas surrounding the bulb, thereby letting the bulb "believe" that the gas be superheated, with the result that the flow control means is open.

Practically, and contrary to the prior art, the invention results in the gas discharged b the evaporator very often containing some liquid instead of being fully evaporated and superheated.

This has little or no effect on the efficiency of the system since, in most cases, gas coming from the evaporator is then used to cool the electrical motor driving the compressor and there is a loss created by the fact of cooling the motor; and it does not matter whether this loss is achieved b heating a dr gas and expanding its volume or by vaporizing the liquid of a wet gas, because in both cases the volume to be compressed, and the energy necessary for compressing this volume of gas, will be the same.

Besides allowing a very substantial cost improvement, the zero degree superheat expansion valve according to the invention leads to some remarkable results.

Firstly, its reaction time is extremely fast and substantially eliminates hunting. This is a result of the fact that the bulb pressure equilibrium is dictated by liquid phase on both sides of the bulb wall, instead of gas on at least one side (usually the external side); this increases transfer coefficients b many ten times.

This is not true with designs as shown in U.S. Pat. No. 4 467 613 with the bulb completely outside the discharge pipe. In such a case there is a delay in heat transfer which is eliminated b the invention.

Furthermore, this invention eliminates one of the major drawbacks of the prior art according to the U.S. Pat. No. 4 467 613, i.e. operation uncertainties. As a matter of fact, it has been found that even when the gas discharged by the evaporator does not contain liquid, an outside bulb heated by a resistor could act as if the gas was containing a lot of liquid, due to a lot of heat being absorbed by the pipe. This occurs when there is liquid on the inner wall of the pipe. Such liquid may be oil returning to the compressor, for example or remaining drops of liquid refrigerant not et fully vaporized.

According to the invention, these major drawbacks are eliminated and a reliable measurement is possible due to the fact that the bulb receives its heat or cold directly from the flow of gas leaving the evaporator.

According to a preferred feature of this invention, the bulb is thermally insulated from the discharge pipe so as not to be thermally influenced by the liquid along the wall of the discharge pipe. Such insulation may be for instance a plastic element which has, simultaneously, the advantage of easily being deformed and providing a good leak-tightness between the bulb and the discharge pipe, although the bulb is usually not perfectly cylindrical.

There is also a second range of advantages of the invention. Basically, as is well known, thermal expansion valves are not appropriate for accurately controlling an evaporator on a very large range of capacities. Usually a thermal expansion valve does not operate when the refrigerant flow rate is lower than one third of full load if this valve is appropriate for operating correctly at full load. This implies that two or three valves of different capacities must be used in parallel so as to be able to still control the refrigerant liquid flow to the evaporator when the system and accordingly the compressor have to operate in the 10–30% capacity range.

The invention has the unexpected effect of eliminating this drawback. More specifically, this invention allows the same valve to control the refrigerant system on the whole range of operation, usually from 10–20% to full load.

More specifically, in a preferred embodiment of the invention, the heating means are partially or totally disconnected when the requested cooling capacity drops below a certain value, for instance 50%. Such disconnection can be actuated by the capacity control of the compressor (the compressor is provided with capacity control means which operate, usually automatically for matching the amount of compressed fluid produced by the compressor to the flow rate of refrigerant fluid through the evaporator).

When the heating means are shut off (or, alternatively, partially disconnected) the bulb operates as a standard bulb, i.e. requests superheat from the evaporator. This is possible at part load even if the evaporator is relatively small-sized in view of its possible cooling capacity at full load. And now, with the invention, nothing prevents in the construction of the valve, to set the spring so as to double or treble the superheat requested for maximum opening of the valve, since, according to the invention, this superheat is given b the heater. This gives still a lot of superheat and spring bias available at part load, and this makes the valve responsive for much lower flow rates than in the prior art, as will be explained in the description hereinafter.

This invention will be better understood by reading the description hereinafter of embodiments of the invention given as non-limiting examples in relation with the accompanying drawings, in which.

Figure 1:
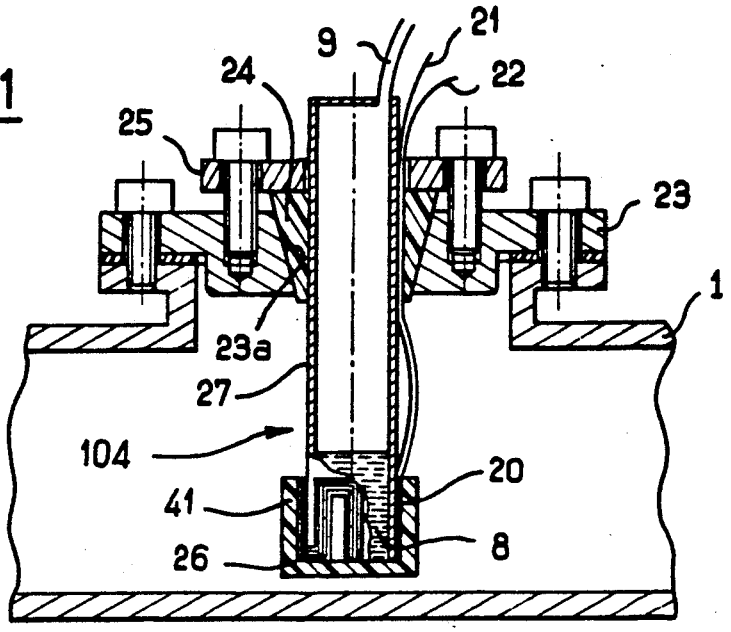
FIG. 1 is a cross-sectional view of the bulb used according to the invention, with part of the bulb being shown in elevation to show the heater resistor.
Figure 2:
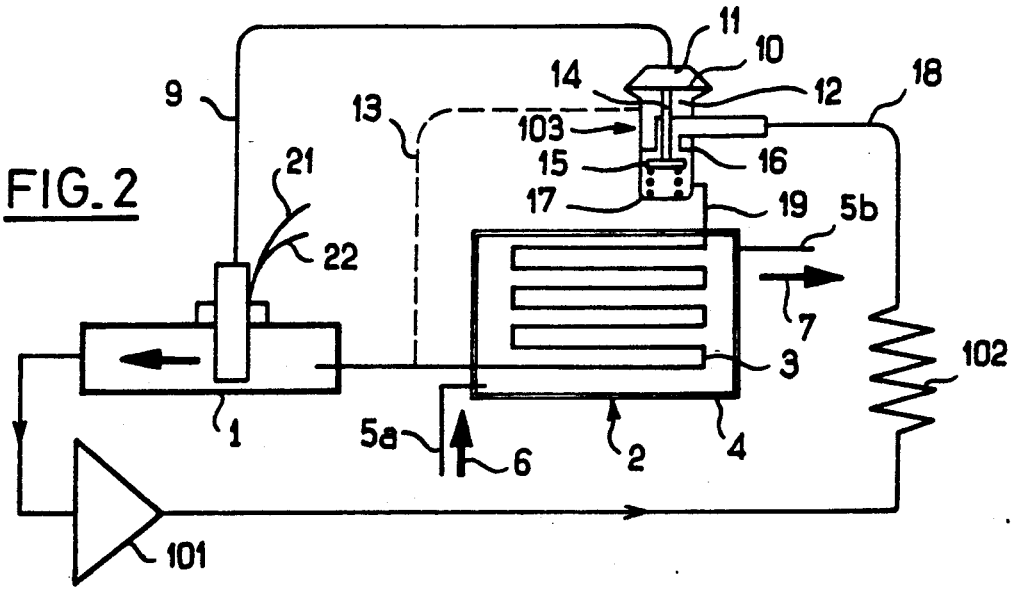
FIG. 2 is a diagram of the refrigeration machine using the invention.

As seen in FIG. 2, an example of a refrigerating machine schematically comprises a compressor 101 compressing refrigerating fluid in the gaseous state and discharging said fluid into a condenser 102, in which said fluid is condensed. The condensed fluid is then sent through a duct 18 to a controlled expansion-valve 103, in which the refrigerating fluid pressure is decreased, and then, through a duct 19, to an evaporator 2 in which the fluid is vaporized and thus absorbs heat. A refrigerant discharge pipe 1 of the evaporator 2 is connected to an inlet of the compressor 101. The evaporator 2 comprises a refrigerant pipe 3 in a vessel 4 in which water to be cooled circulates between a water inlet pipe **5*a* and a water outlet pipe 5*b* along arrows 6 and 7**.

The expansion valve comprises a membrane 10 having one side 11 exposed to the pressure of a bulb 104 which is secured to the refrigerant discharge pipe 1 of the evaporator and will be described later, and another side 12 exposed to the pressure in the discharge pipe 1 by an external equalizing line 13; the membrane 10 urges via rod 14 a flow control piston 15 away from its seat 16 against the biasing force of a spring 17.

The pressure inside the bulb 104 is transmitted to side 11 of the membrane 10 by a pressure transmitting means such as a capillary 9.

The bottom part of the bulb is surrounded b an electrical heating resistor 20 which is conventionally made on a plastic foil partly covered by resistance material seen on 26, wrapped around the bulb; it is maintained and pressed against the bulb by a cover 41 which is conceivably made of plastic. Electrical current is supplied to the resistor 20 by wires 21 and 22.

The bulb is held into the pipe 1 by a metal flange 23 having a conical bore 23*a* therethrough in which a plastic cone 24—made for instance of PTFE (polytetrafluoroethylene) is pressed by flange 25. The plastic cone 24 has a cylindrical through-bore axially therethrough, and the bulb 104 and wires 21 and 22 are leak-tightly mounted in said cylindrical through-bore. The plastic cone deforms so as to let the passage for the electrical wires 21 and 22 while sealingly separating the inside of the pipe 1 containing refrigerant gas and liquid from the ambient air outside. The plastic cone 24 maintains the bulb 104 in a position in which a major part, and especially the bottom part, of the bulb 104 extends inside the discharge pipe 1, transversely thereto, so as to be exposed to refrigerant flow inside discharge pipe 1.

The plastic cone 24 also provides to the bulb heat-insulation against heat or cold coming from the walls of the pipe 1. This allows the temperature inside the bulb to be basically dependant upon the amount of heat generated by the resistor and the amount of cold received by the area 27 of the bulb which is exposed to refrigerant flow.

The system operates as follows:

When the compressor 101 operates at full load, the resistor 20 is energized and heats the liquid 8 in the bulb, thereby increasing the pressure in the bulb and in a volume adjacent side 11 of the membrane 10 which in turn pushes against the spring 17 and opens the piston 15 allowing liquid refrigerant coming from condenser 102 to flow into the evaporator 2.

In case the amount of heat available from water circulating in vessel 4 becomes insufficient, the refrigerant fluid can no longer fully vaporize in evaporator 2 and droplets of liquid appear in discharge pipe 1. Only at this stage, i.e. when liquid droplets carried along in pipe 1 start hitting the area 27 of the bulb, the bulb cools down and the pressure in the bulb decreases, thereby reducing pressure on the membrane 10 and closing progressively the piston 15. It should be noted that an important feature of the invention is the close proximity between the area where heat is provided to the bulb, the area where cold is received b the bulb and the liquid contained in the bulb. This insures that calories do not have to travel through lengthy pieces of copper. Such travel limit the heat transfer rate, and would (a) make the final equilibrium pressure in the bulb and hence the expansion valve opening much more sensitive to secondary factors such as ambient temperature which should have no influence onto the control, (b) delay the response of the valve 103 to a change of conditions and hence make it liable to hunt.

Figure 3:
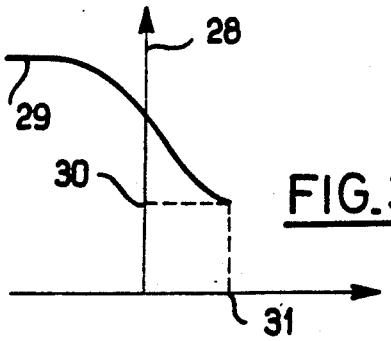
FIG. 3 is a diagram showing the pressure difference across the membrane as a function of superheat —on negative abscissa—or liquid content of the gas in weight on the positive abscissa.

FIG. 3 shows the results achieved with this invention. The positive asbcissa indicates the percentage in weight of the liquid carried along by the wet gas. The vertical line 28 corresponds to 0% liquid but the gas being without superheat. The negative side of the abscissa shows the amount of superheat and the ordinate shows the differential pressure across the membrane.

As a numerical example, a bulb of approximately 15 mm in diameter and 110 mm in length is installed into a pipe having around 70 mm in diameter and actuates an expansion valve operating a 50 ton air-conditioning system. The electrical resistor provides around 25 watts to the bulb, the system is operated with refrigerant R-22 and the evaporating temperature is set at 7° C. The amount of liquid in the valve is limited so that it is full vaporized when the differential pressure reaches around 3 bars as shown at 29. At that value, the valve is fully opened, further superheat would not open it more, and the superheat at that point is around 1° C.

When superheat decreases, the differential pressure drops and reaches around 2 bars when superheat disappears but the gas is still dry.

When flow control means 15 opens further, the pressure continues to drop down until it reaches a value 30 approximately equal to 1 bar and the amount of liquid carried along b the gas in percentage of weight reaches a value 31 which, in this case, is around 1 percent. Further increase of liquid content, which would be artificially injected into the pipe upstream of the bulb, would not decrease the differential pressure. Therefore the spring tension is set such that the piston 15 is full closed for this one bar difference across the membrane 10.

The result is hence that maximum capacity is now achieved with 1 degree superheat instead of the usual 5 or 6 degrees, thereby allowing elimination of most of the superheat generating area of the evaporator.

It is of course possible to displace the curve of FIG. 3 toward the right b increasing the power of the resistor so as to have the valve operate nearly completely in the wet area instead of having it operate partly in the superheat area. This helps to increase the cooling capacity of the evaporator but increases the amount of liquid which is going through the system without vaporization.

According to an advantageous feature, at part load, the power generated b resistor 20 can be reduced or set to zero, thus allowing the thermal expansion valve to operate in a conventional manner.

Figure 4:
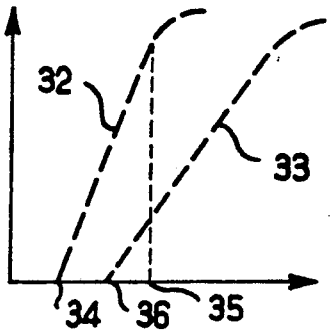
FIG. 4 is a diagram showing the amount of opening of the valve as a function of the pressure difference across the membrane.

FIG. 4 explains the advantage obtained thereby:

It shows the amount of opening of the valve 103 in ordinate and the pressure differential in abscissa, the curve 32 being the curve of a conventional valve and the curve 33 being the curve of a preferred embodiment of this invention.

Conventionally a standard thermal expansion valve starts to open when the pressure differential—given b the superheat—reaches value shown in 34 and is fully opened for differential pressure 35.

As the total superheat has to be limited in order not to increase too much the size of the evaporator, the slope of the curve 32 has to be steep, whereby the sensibility of the opening to a change in the superheat is quite high and the valve operation is therefore not very accurate. Furthermore, when the amount of superheat decreases to a point where the pressure differential comes close to value 34, the opening of the valve becomes erratic, one reason being that, in most valves, the piston 15 is not pressure balanced on its two sides with the result that it tends to close and remain closed or to open and remain open. Thus, the valve is not controlling well in the pressure differential area near point 34 corresponding to part load conditions generally below 35 or 40%.

With the invention, the maximum superheat seen by the bulb is no longer limited as it is dictated by the resistor, not by the superheat of the evaporator gas, and it is possible to have it operate with a much less steeper slope which allows a much greater sensibility and the possibility of still keeping large pressure difference across the membrane even at low part load.

Such valve is thus now able to operate down to 20% load or even lower if needed, thereby eliminating the need to provide a plurality of valves operating in parallel.

It is also possible to displace the opening point to the right to a position such as 36 i.e. to allow the valve to operate with more superheat than usual, thereby reducing the risk in hot gas, when the system has been standing idle, to see the bulb open the expansion valve and flood the evaporator.

It should be noted that according to the invention: the resistor could be mounted inside the bulb instead of around the bulb; the bulb, instead of being mounted vertically could be mounted obliquely or horizontally; the external equalizer line could be replaced by a conventional internal equalizer or could be connected to another portion of the low-pressure part of the refrigerating machine, i.e. between the expansion valve outlet and the compressor inlet; the bulb, instead of being a straight tube, could have a different shape, and for instance be curved; the resistor shown at the bottom of the bulb could be mounted at the upper part, the cooling area in contact with the wet gas being in the lower part; instead of using the same fluid in the bulb as in the refrigeration system, a different fluid could be used; the amount of liquid in the bulb could be limited so as to limit the maximum pressure on the membrane to the value achieved when liquid is full vaporized; instead of using an electric heater, heat could be generated by other means, for instance a burner, and could be brought to the bulb by a thermal transfer means such a heat tube; other means than a spring, such as pressure of a gas, could be used to bias the membrane; the membrane could be replaced by another differential pressure measuring device, such as a piston; at part load, the heater could be disconnected progressively by steps in relation to the unloading of the system so as to go from 100% heat to 0% in relation to the refrigeration load. Furthermore, the bulb 104 is not necessarily secured to the discharge pipe 1 through a heat-insulating means (cone 24). Heat transfer from pipe 1 may be at least partially compensated for by increasing the surface of the bulb 104 exposed to the refrigerant flow in pipe 1 with respect to the surface in contact with the pipe, and/or by setting the ohmic value of the resistor and/or the bias force of the spring 17. Such compensations for heat-transfer from pipe 1 to bulb 104 are especially easy in the evaporators in which the discharge pipe 1 remains at a substantially constant temperature, e.g. the evaporators producing cold water (so-called "chillers"), wherein the discharge pipe 1 constantly has an external temperature nearly equal to that of water and an internal temperature nearly equal to that of refrigerant fluid, with said temperatures being permanently maintained within a narrow range slightly above 0° C.

We claim:

1. The method for controlling a refrigeration system having an evaporator for passing a refrigerant from an adjustable thermal expansion valve to a pipe downstream from the evaporator with reference to direction of refrigerant flow, the system being capable of operating to maintain the refrigerant in the evaporator within a pressure/temperature region in which a substantial percentage of refrigerant in said pipe is in a liquid phase and further including a bulb for controlling operation of the thermal expansion valve, the bulb having a heat conductive wall with opposite inner and outer surfaces and containing a fluid having a liquid phase at least partially filling the bulb, the operation of the expansion valve being dependent on a thermal balance between the bulb contained fluid and refrigerant outside of the bulb, and including means for heating the bulb contained fluid, the method comprising the steps of:

mounting the bulb with at least a portion of aid heat conductive wall extending within the pipe downstream from the evaporator and thereby enveloping at least a substantial portion of the bulb outer surface with refrigerant flow in the pipe;

exposing at least part of the opposite inner surface portion of said heat conductive wall to fluid in said bulb; and energizing said heating means to direct a substantial portion of the heat thereof to the liquid phase of fluid contained in the bulb at least when the refrigerant flow in the discharge pipe contains a liquid phase.

2. A method according to claim 1, wherein said bulb is attached to said pipe by heat transfer isolating means.

3. A method according to claim 1, wherein the system operates at maximum load capacity in said pressure/temperature region, and including the step of deenergizing the heating means at least when the system operates at low partial load capacities.

4. A refrigeration system comprising:

an evaporator for passing a refrigerant from an adjustable thermal expansion valve to a pipe downstream from the evaporator with reference to direction of refrigerant flow;

a compressor having a suction inlet connected to the pipe, the compressor being capable of operating to maintain the refrigerant in the evaporator within a pressure/temperature region in which a substantial percentage of refrigerant in said discharge pipe is in a liquid phase;

a bulb for controlling operation of the thermal expansion valve, the bulb having a heat conductive wall with opposite inner and outer surfaces and containing a fluid having a liquid phase at least partially filling the bulb, the operation of the expansion valve being dependent on a thermal balance between the bulb contained fluid and the refrigerant in said pipe;

means for mounting the bulb with at least a portion of said heat conductive wall extending within the pipe downstream from the evaporator so that at least a substantial portion of the bulb outer surface is enveloped by refrigerant flow in the pipe and to expose the opposite inner surface portion of said heat conductive wall to liquid phase fluid in said bulb; and means for heating the bulb contained fluid to adjust said thermal balance at least when the refrigerant flow in the pipe downstream from the evaporator contains a liquid phase, said heating means being arranged so that a substantial portion of the heat thereof is directed to the liquid phase of the bulb contained fluid.

5. The system according to claim 4 wherein said bulb extends substantially across the inside of said pipe downstream from the evaporator.

* * * * *

UNITED STATES PATENT AND TRADEMARK OFFICE

CERTIFICATE OF CORRECTION

PATENT NO. : 5,195,331

DATED : March 23, 1993

INVENTOR(S) : Bernard Zimmern and Jean L. Picouet

It is certified that error appears in the above-indentified patent and that said Letters Patent is hereby corrected as shown below:

On the title page, item [75], after "Inventors", change "Jean L Picouet" to --Jean L. Picouet--.

Claim 1, column 8, line 15, change "aid" to --said--; and

Signed and Sealed this

Twenty-third Day of November, 1993

*Attest:*

*Attesting Officer*

BRUCE LEHMAN

*Commissioner of Patents and Trademarks*